US005138856A

United States Patent [19]

Chyun

[11] Patent Number: 5,138,856

[45] Date of Patent: Aug. 18, 1992

[54] ANTI-PICK LOCK

[75] Inventor: Su W. Chyun, Taichung Hsien, Taiwan

[73] Assignee: Tian Y. Chen, Chung Ho, Taiwan

[21] Appl. No.: 732,111

[22] Filed: Jul. 18, 1991

[51] Int. Cl.[5] ..... E05B 27/06

[52] U.S. Cl. ..... 70/493; 70/375; 70/379 R; 70/409; 70/419

[58] Field of Search ..... 70/375, 419, 492, 493, 70/409, 358, 373, 372, 379 R, 379 A

[56] References Cited

U.S. PATENT DOCUMENTS

| | | | |
|---|---|---|---|
| 929,668 | 8/1909 | Hartman | 70/375 |
| 2,009,640 | 7/1935 | Stone et al. | 70/337 |
| 2,491,337 | 12/1949 | Segal | 70/419 |
| 4,148,201 | 4/1979 | Miyamae et al. | 70/419 X |
| 4,838,061 | 6/1989 | Tai-Seng | 70/493 |

FOREIGN PATENT DOCUMENTS

| | | | |
|---|---|---|---|
| 420310 | 3/1948 | Italy | 70/493 |
| 2159564 | 12/1985 | United Kingdom | 70/358 |

*Primary Examiner*—Lloyd A. Gall

*Attorney, Agent, or Firm*—Peterson, Wicks, Nemer & Kamrath

[57] ABSTRACT

A lock including a sleeve fixed in the body and having a number of orifices, a stud and a spring received in each of the orifices, a barrel received in the sleeve and including a number of apertures and a bore for rotatably receiving a core which includes a notch, and a key engageable with the notch of the core and including a number of depressions, the barrel can not be rotated when the studs are engaged between the sleeve and the barrel, and the barrel can be rotated when the studs are biased to engage within the apertures of the barrel.

3 Claims, 2 Drawing Sheets

ANTI-PICK LOCK

BACKGROUND OF THE INVENTION

1. Field of the Invention

The present invention relates to a lock.

2. Description of the Prior Art

Typical locks includes a key insertable into a lock body for actuating a latch in order to lock or to open the lock. Generally, the latches can be easily actuated by a longitudinal or slender object such that the locks can be easily opened by a thief or the like.

The present invention has arisen to mitigate and/or obviate the afore-described disadvantages of the conventional locks.

SUMMARY OF THE INVENTION

The primary objective of the present invention is to provide a lock which can not be easily opened by a longitudinal object.

In accordance with one aspect of the invention, there is provided a lock including a sleeve fixed in the body, the sleeve including a key hole and a number of orifices, a stud and a spring received in each of the orifices, a barrel rotatably received in the sleeve and including a bore for rotatably receiving a core and a number of apertures corresponding to the orifices of the sleeve, a pin engaged in the barrel, the core including a notch and a shoulder engageable with the pin of the barrel, and a key engageable within the notch of the core and including a number of depressions, the studs being biased by the springs to engage between the sleeve and the barrel so that the barrel can not be rotated relative to the sleeve, and the studs being biased to engage within the depressions of the key and the apertures of the barrel when the depressions of the key are aligned with the apertures of the barrel, so that the barrel can be rotated.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
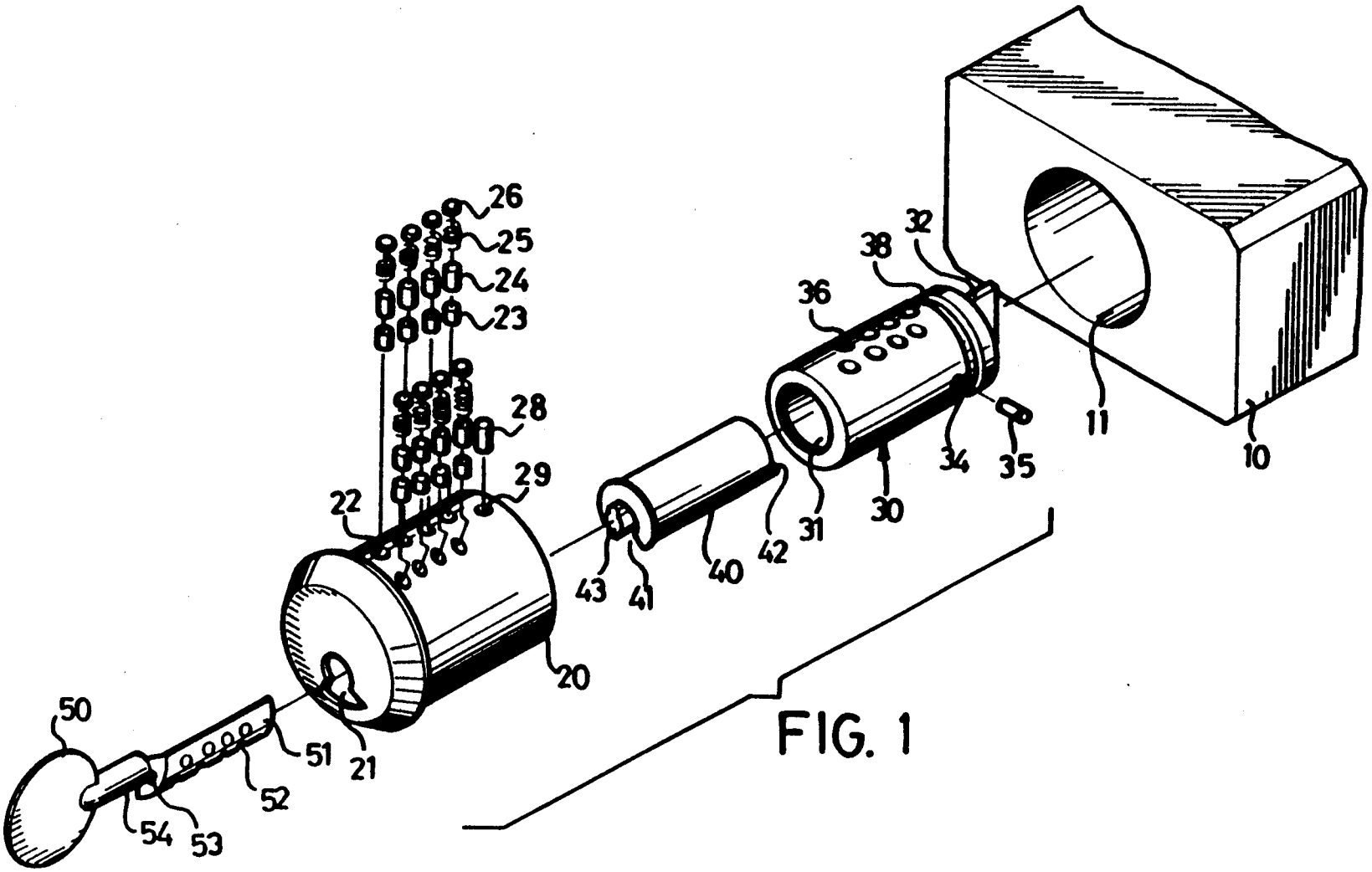
FIG. 1 is an exploded view of the lock.
Figure 2:
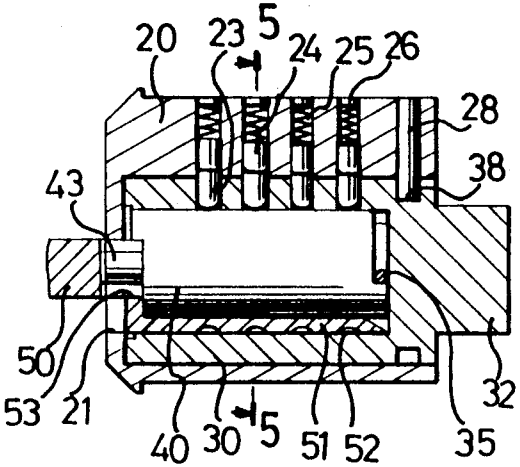

Referring to the drawings and initially to FIGS. 1 and 2, a lock of the invention comprises a body 10 having an opening 11 formed therein, a sleeve 20 fixed in the opening 11 of the body 10 and having a key hole formed in the outer end, a barrel 30 rotatably received in the sleeve 20, a core 40 rotatably received in the barrel 30, and a key 50 insertable into the core 40 via the key hole 21 of the sleeve 20.

The sleeve 20 has a plurality of orifices 22 formed therein. Two studs 23, 24 and a spring 25 are received in each of the orifices 22 of the sleeve 20, and a lid 26 is fixed in the outer end of each of the orifices 22 and is flush with the outer peripheral surface of the sleeve 20. A peg 28 is either slidably engaged in or fixed in a cavity 29 of the sleeve 20 and extends inward of the sleeve 20. The barrel 30 includes a bore 31 formed therein and a member 32 integrally formed on an inner end thereof. A latch (not shown) of the lock can be actuated by the member 32 when the barrel 30 is rotated so that the lock can be opened and locked. A hole 34 is formed in the barrel 30 for receiving a pin 35 which extends into the bore 31 of the barrel 30. A plurality of apertures 36 are formed in the barrel 30 corresponding to the orifices 22 of the sleeve 20. The first stud 23 can be biased to engage within the respective aperture 36 when the apertures 36 of the barrel 30 and the orifices 22 of the sleeve 20 are aligned with one another. A groove 38 or an annular groove is formed in the outer peripheral portion of the barrel 30 for slidably receiving the peg 28 so that the barrel 30 can not move longitudinally relative to the sleeve 20 and is guided to make a rotational movement only.

The core 40 is rotatably received in the bore 31 of the barrel 30 and includes a notch 41 longitudinally formed in the peripheral portion thereof and a shoulder 42 formed in the inner end thereof. A protrusion 43 is formed in the middle portion of the notch 41. The key 50 includes an element 51 and a rod 54 formed integral with each other. The element 51 is insertable through the key hole 21 of the sleeve 20 and is insertable into the notch 41 of the core 40. The element 51 has a plurality of depressions 52 formed therein and has a recess 53 formed between the rod 54 and the element 51. The protrusion 43 of the core 40 is engageable with the recess 53 of the key 50.

Figure 4:
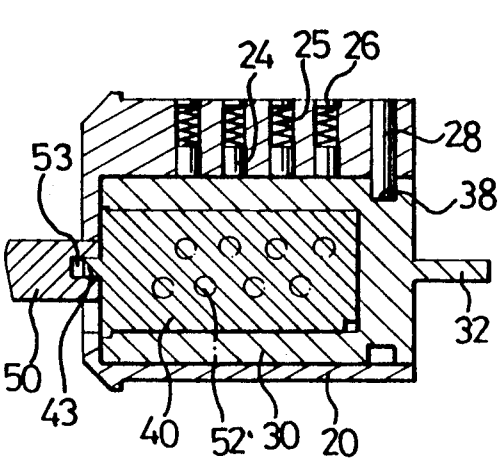
FIGS. 2, 3 and 4 are cross sectional views taken along lines 2—2 of FIG. 5.
Figure 5:
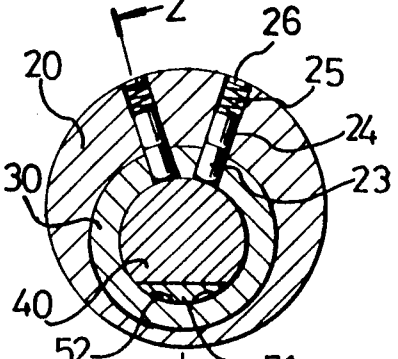

In operation, referring next to FIGS. 2 to 7, and initially to FIGS. 2 and 5, the element 51 of the key 50 is inserted through the key hole 21 of the sleeve 20 and is engaged in the notch 41 of the core 40. The core 40 can be rotated by the key 50. The first studs 23 are partially engaged in the orifices 22 of the sleeve 20 and the apertures 36 of the barrel 30; i.e., engaged between the sleeve and the barrel 30, so that the barrel 30 can not be rotated relative to the sleeve 20 and so that the look is locked. At this moment, the rotational movement of the core 40 is limited by the engagement between the shoulder 42 and the pin 35.

Figure 3:
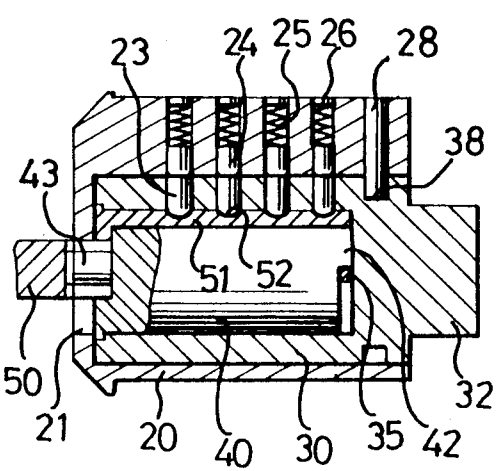
Figure 7:
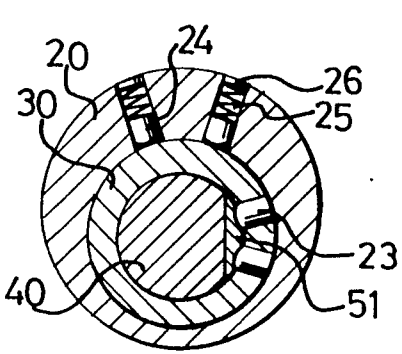
FIGS. 5, 6 and 7 are cross sectional views taken along lines 5—5 of FIG. 2.
Figure 6:
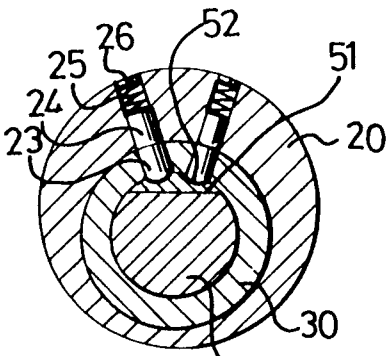

As shown in FIGS. 3 and 6, when the key 50 is rotated such that the depressions 52 of the element 51 are aligned with the respective apertures 36 of barrel 30, the first studs 23 are biased to engage within the depressions 52 of the element 51 by the springs 25 such that the first studs 23 are engaged within the apertures 36 of the barrel 30 and the second studs 24 are engaged within the orifices 22 of the sleeve 20. At this moment, the barrel 30 is rotatable relative to the sleeve 20. The shoulder 42 of the core 40 and the pin 35 are arranged such that the barrel 30 can be rotated by the core 40 by the engagement between the shoulder 42 of the core 40 and the pin 35 when the depressions 52 of the element 51 are aligned with the respective apertures 36 of barrel 30 such that the barrel 30 can be rotated to the position as shown in FIGS. 4 and 7, and such that the member 32 can be rotated to actuate the latch of the lock.

Accordingly, the lock in accordance with the present invention can not be opened when the arrangement of the depressions 52 of the key 50 is not accorded with the arrangement of the apertures 36 of the barrel 30, such that the lock can not be easily opened by a longitudinal or slender object.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lock comprising a body having an opening formed therein; a sleeve fixed in said opening of said body and including a key hole formed in one end thereof and a plurality of orifices formed in a peripheral portion thereof; a first stud, a spring and a lid being received in each of said orifices; a barrel rotatably received in said sleeve and having a member formed integral on one end thereof, said member being located within said lock, said barrel including a bore longitudinally formed in a center thereof and a plurality of apertures formed in a peripheral portion thereof corresponding to said orifices of said sleeve, a pin engaged in said barrel and extending inward of said barrel; a core rotatably received in said barrel and including a notch longitudinally formed in a peripheral portion thereof and a shoulder formed on one end thereof, said shoulder being engageable with said pin of said barrel, said core further including a protrusion formed on the other end thereof distal from said shoulder; and a key including an element insertable through said key hole of said sleeve and engageable with said notch of said core, said element including a recess engageable with said protrusion of said core and a plurality of depressions formed therein corresponding to said apertures of said barrel, said core can be actuated to rotate by said key by engagement between said protrusion of said core and said recess of said key; said first studs being biased by said springs to engage between said sleeve and said barrel so that said barrel can not be rotated relative to said sleeve; and said first studs being biased to engage within said depressions of said key and said apertures of said barrel when said depressions of said key are aligned with said apertures of said barrel, so that said barrel can be rotated by engagement between said shoulder of said core and said pin of said barrel.

2. A lock according to claim 1 further comprising a second stud received in each of said orifices of said sleeve and disposed between said spring and said first stud, said first studs are received in said apertures of said barrel and said second studs are received in said orifices of said sleeve respectively when said depressions of said key are aligned with said apertures of said barrel such that said barrel can be rotated relative to said sleeve.

3. A lock according to claim 1, wherein a peg is engaged in said sleeve and extends inward of said sleeve, a groove is formed in said peripheral portion of said barrel, said peg is slidably engaged in said groove of said barrel so that said barrel can not move longitudinally relative to said sleeve.

* * * * *